United States Patent [19]

Figueroa

[11] Patent Number: 4,606,124

[45] Date of Patent: Aug. 19, 1986

[54] METHOD OF AND APPARATUS FOR CUTTING A CARPET

[76] Inventor: LeRoy R. Figueroa, 6723 Desert Rose, Houston, Tex. 77086

[21] Appl. No.: 724,869

[22] Filed: Apr. 19, 1985

[51] Int. Cl.[4] ..... B26B 29/00

[52] U.S. Cl. ..... 30/293; 30/282

[58] Field of Search ..... 30/293, 294, 290, 282, 30/292, 319, 320; 7/103

[56] References Cited

U.S. PATENT DOCUMENTS

| | | | |
|---|---|---|---|
| 2,571,527 | 10/1951 | Boyer | 30/319 X |
| 2,601,183 | 6/1952 | Unsinger | 30/293 |
| 4,148,142 | 4/1979 | Sullivan et al. | 30/294 X |

*Primary Examiner*—Douglas D. Watts

*Attorney, Agent, or Firm*—Fulbright & Jaworski

[57] ABSTRACT

A carpet cutting knife and method for cutting a straight edge along a carpet edge having a body with a guide wall for engaging the edge of the carpet and a base for engaging one surface of the carpet. A support plate engages the second surface of the carpet and is positioned parallel to the base and is adjustably supported from the body for accommodating carpets of different thicknesses. A cutting blade is adjustably connected to the plate for adjusting the distance between the cutting blade and the guide wall and extends between the plate and base for cutting a carpet positioned between the plate and the base.

2 Claims, 4 Drawing Figures

Fig. 1
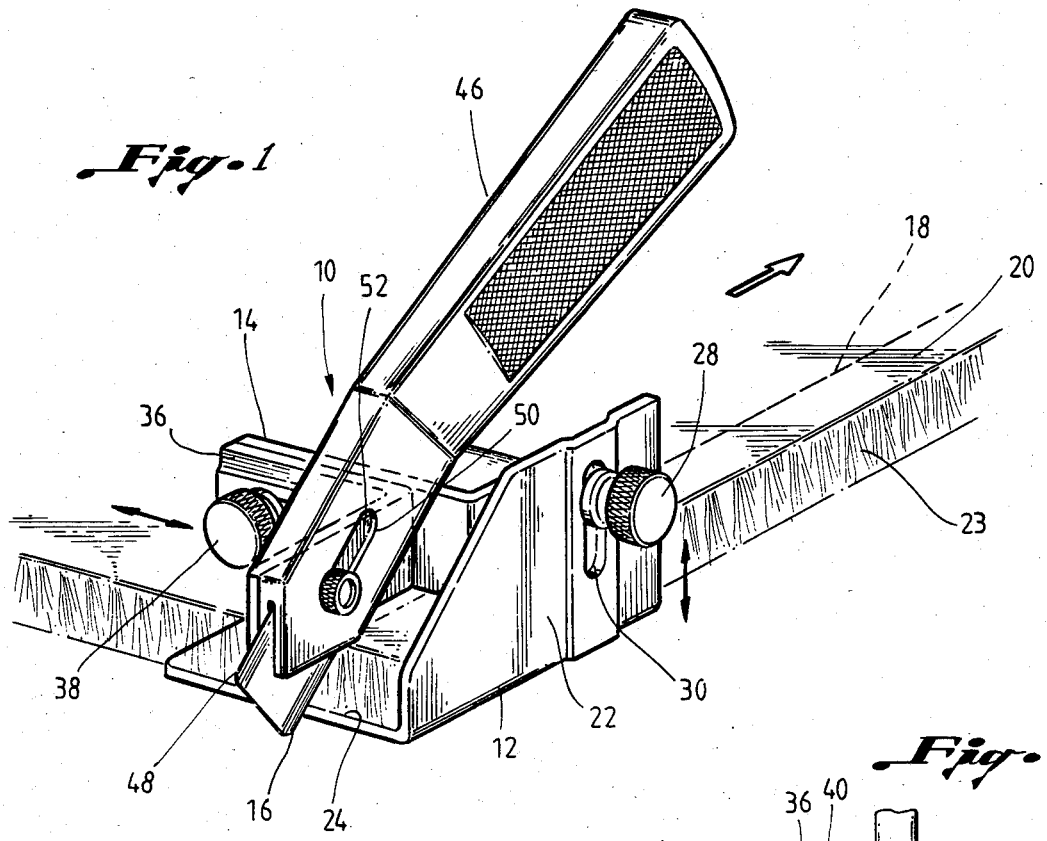
Fig. 3
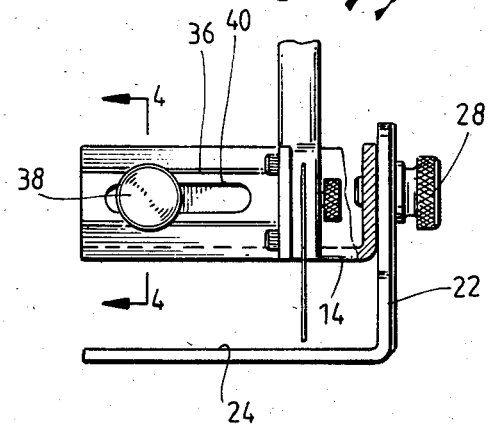
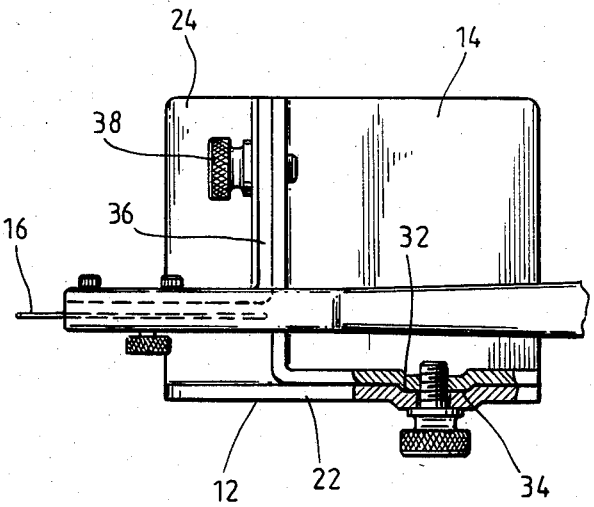
Fig. 2
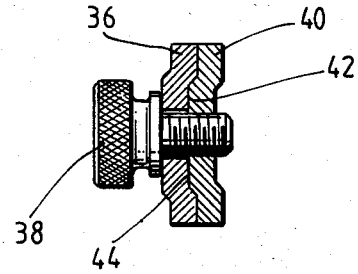
Fig. 4

METHOD OF AND APPARATUS FOR CUTTING A CARPET

BACKGROUND OF THE INVENTION

Generally, carpet shipped from the factory has edges which are not suitable for making a seam with another piece of carpet. That is, in shipping the edges are frequently damaged. Also, the mill, in trimming the carpet, may trim the carpet fibers at an angle. In either event, the edges are not suitable to provide a neat seam in which the edges of the carpet all have the same height. Therefore, it is necessary to cut off the edges of many carpets prior to making a seam. This is time consuming and is generally performed by measuring and drawing a line along the carpet and cutting the carpet with scissors or a knife. This process is labor intensive and thus expensive, and yet frequently results in an uneven and unsatisfactory carpet edge.

The present invention is directed to a method and apparatus for cutting a straight edge along a carpet which provides a neat and uniform edge for making a seam.

SUMMARY

One feature of the present invention is the provision of a carpet cutting knife for cutting a straight edge along a carpet edge in which the body has a guide wall for engaging the edge of a carpet for providing a guideline for cutting the carpet and having a base for engaging one surface of the carpet. A support plate is adjustably supported from the body for moving the plate toward and away from the base for accommodating carpets of various thicknesses and for using the surfaces of the carpet as support surfaces for supporting the cutting knife. Cutting means is adjustably connected to the plate for adjusting the distance between the cutting means and the guide wall for adjusting the amount of carpet to be cut off.

Another object of the present invention is the provision of a handle connected to the apparatus for moving the apparatus relative to the carpet.

Still another object is the provision of means for replacing and adjusting the extended length of the cutting means for replacing the cutting means as it wears, and adjusting its length to provide a new cutting surface when needed, and adjusting the length to compensate for various carpet thickness.

Yet a still further object of the present invention is the provision of a carpet knife having an L-shaped body including a guide wall for engaging the edge of a carpet and a base perpendicular to the guide wall for engaging one surface of the carpet. A support plate is positioned parallel to the base for engaging the second surface of the carpet and the plate is adjustably connected to the guide wall for moving the plate toward and away from the base for accommodating carpets of various thickness while supporting the body securely. A cutting blade is adjustably connected to the plate for adjusting the distance between the cutting blade and the guide wall for adjusting the amount of carpet to be cut off and the cutting blade extends between the plate and the base for cutting a carpet positioned between the plate and the base.

Still a further object is the provision of a method of cutting a carpet along and adjacent an edge of the carpet which includes moving a cutting blade parallel to and spaced from the edge of the carpet for cutting a new edge on the carpet, and while cutting the carpet, guiding the knife from the old edge of the carpet for making the new edge parallel to the old edge, and while cutting, supporting the knife from the upper and lower surfaces of the carpet. The method includes adjusting the width of the carpet to be cut by adjusting the distance between the cutting blade and the old edge of the carpet.

Other and further objects, features and advantages will be apparent from the following description of a presently preferred embodiment of the invention, given for the purpose of disclosure and taken in conjunction with the accompanying drawings.

BRIEF DESCRIPTION OF THE DRAWINGS

FIG. 1 is an elevational perspective view of the carpet cutting knife of the present invention cutting a straight edge along a carpet, FIG. 2 is a fragmentary top elevational view of the apparatus shown in FIG. 1, FIG. 3 is a fragmentary front elevational view of the apparatus of FIG. 1, and FIG. 4 is an enlarged cross-sectional view taken along the line 4—4 of FIG. 3.

DESCRIPTION OF THE PREFERRED EMBODIMENT

Referring now to the drawings, the reference numeral 10 generally indicates the carpet cutting knife of the present invention and generally includes a body 12, a support plate 14, and cutting means 16 for cutting a straight edge 18 along a carpet 20.

The body 12 is preferably an L-shaped body having a guide wall 22 for slidably moving along the old edge 23 of the carpet 20 and a base 24 perpendicular to the guide wall 22 for engaging one surface, such as the bottom, of the carpet 20.

The support plate 14 is positioned parallel to the base 24 for engaging the second surface, such as the top, of the carpet 20. The plate 14 is adjustably connected to the guide wall 22 for moving the plate 14 toward and away from the base 24 for accommodating carpets 20 of various thicknesses. The adjusting means may include a screw 28 extending through an elongate slot 30 of the guide wall 22 and threadably engaging the plate 14. In order to securely align and hold the plate 14 against the guide wall 22, the guide wall 22 may include a groove 32 and the plate 14 may include a track 34 movable in the groove 32. Therefore, by loosening the screw 28, the plate 14 may be vertically adjusted to the desired height and the screw 28 tightened to retain the plate 14 in the desired position.

The cutting means 16, such as a cutting blade, is adjustably connected to the plate 14 for horizontally moving the cutting means 16 for adjusting the distance between the cutting blade 16 and the guide wall 22 for cutting along the line 18. The cutting blade 16 extends between the plate 14 and the base 24 for cutting through a carpet 20 positioned between the plate 14 and the base 24. Preferably, the cutting blade 16 extends downwardly in front of the base 24 and downwardly a sufficient distance to cut through various thickness of the carpet 20.

The adjustment for the cutting blade 16 may include a bracket 36 supporting the cutting means 16, a threaded screw 38 movable relative to a slot 40 in the bracket 36 and threaded to the plate 14. As best seen in FIG. 4, the bracket 36 may include a horizontal extending groove 42 and the plate 14 may include a track 44 slidably moving in the groove 42.

A handle 46 may be provided connected to the apparatus 10 such as to the bracket 36 for moving the apparatus 10 relative to the carpet 20.

In addition, suitable means may be provided for replacing and adjusting the extended length of the cutting blade 16 such as a screw 48 extending through a slot 50 in the handle and a slot 52 in the blade 16 and threadably connected to the bracket 36. Thus the blade 16 may be easily replaced or may be extended to change the cutting surface which is exposed to the carpet 20 when wear occurs.

In use, the height of the plate 14 is adjusted by the screw 28 to accommodate the thickness of the carpet 20 and allow the base 24 to contact one surface of the carpet 20 while the plate 14 contacts the other surface of the carpet 20 for securely holding the apparatus 10 in place on the carpet so that the cutting blade 16 will be firmly supported so that it may make a square cut along the carpet. In addition, the screw 38 is adjusted for setting the distance of the cutting blade 16 from the guide wall 22 to cut a new edge 18 at a location to cut off any damaged or undesired portions of the old edge 23. The handle 46 is gripped and the apparatus 10 is moved along the old edge 23 to cut a new edge 18. While the old edge 23 may be unsatisfactory for making a seam, it is generally sufficiently straight to provide a guide for the inside of the guide wall 22 for making a straight cut 18 in the carpet 20.

The method of the present invention is apparent from the foregoing description of the structure in operation of the present device. However, the method comprehends a method of cutting a carpet along and adjacent one edge of the carpet includes moving a cutting blade parallel to and spaced from the edge of a carpet for cutting a new edge on the carpet and while cutting, guiding the knife from the old edge of the carpet for making the new edge parallel to the old edge and while cutting supporting the knife from the upper and lower surfaces of the carpet. The method further comprehends adjusting the width of the carpet to be cut by adjusting the distance between the cutting blade and the old edge of the carpet.

The present invention, therefore, is well adapted to carry out the objects and attain the ends and advantages mentioned as well as others inherent therein. While a presently preferred embodiment of the invention has been given for the purpose of disclosure, numerous changes in the details of construction, arrangement of parts, and steps of the method, will readily suggest themselves to those skilled in the art and which are encompassed within the spirit of the invention and the scope of the appended claims.

What is claimed is:

1. A hand held carpet cutting knife for cutting a straight edge along a carpet edge comprising, an L-shaped body having a guide wall for engaging an edge of a carpet, and having a base perpendicular to the guide wall for engaging one surface of the carpet, a rigid flat support plate positioned parallel to the base for engaging the second surface of the carpet, a vertically extending track and groove connection between the plate and the guide wall for adjustably moving the plate towards and away from the base for accommodating carpets of various thicknesses, a cutting blade, a horizontally extending track and groove connection between the blade and plate for adjusting the distance between the cutting blade and the guide wall for adjusting the amount of carpet to be cut off, said cutting blade extending between the plate and base and extending behind the base for cutting a carpet positioned between the plate and the base, and a handle connected to the apparatus for moving the apparatus relative to the carpet.

2. The apparatus of claim 1 including, means for replacing and adjusting the extended length of the cutting means.

* * * * *